US012350567B1

(12) United States Patent
Tootle

(10) Patent No.: US 12,350,567 B1
(45) Date of Patent: Jul. 8, 2025

(54) GOLF SWING BACK ANGLE TRAINING DEVICE

(71) Applicant: Rod Tootle, Boerne, TX (US)

(72) Inventor: Rod Tootle, Boerne, TX (US)

( * ) Notice: Subject to any disclaimer, the term of this patent is extended or adjusted under 35 U.S.C. 154(b) by 0 days.

(21) Appl. No.: 18/977,540

(22) Filed: Dec. 11, 2024

(51) Int. Cl.
*A63B 69/36* (2006.01)

(52) U.S. Cl.
CPC .... *A63B 69/3608* (2013.01); *A63B 2225/093* (2013.01)

(58) Field of Classification Search
CPC ..... A63B 69/3608; A63B 2225/093
USPC ..... 473/208, 212, 215, 216, 218, 266, 269, 473/277
See application file for complete search history.

(56) References Cited

U.S. PATENT DOCUMENTS 406,328 A * 7/1889 Yagn
1,618,273 A * 2/1927 Davidson ..... A63B 21/4003 482/124
3,570,011 A * 3/1971 Naig ..... A61F 5/02 2/44
5,050,885 A * 9/1991 Ballard ..... A63B 69/3608 473/216
6,461,256 B1 * 10/2002 Popeck ..... A63B 69/0059 473/450
7,314,437 B2 * 1/2008 Frappier ..... A63B 21/4025 482/126
8,852,014 B1 * 10/2014 Hoang ..... A63B 69/0059 473/216
2008/0234062 A1 * 9/2008 Van Heerden ..... A63B 69/0059 473/277

* cited by examiner

*Primary Examiner* — Nini F Legesse

(57) ABSTRACT

A golf swing back angle training device provides tactile feedback when an undesired change in back angle occurs during a golf swing. The device includes a belt for extending around a waist of a user. A shaft coupled to the belt is positioned in alignment with a spine of the user and extends downwardly towards feet of the user such that a bottom end of the shaft moves away from the feet as the user bends forwardly. A 10 band is coupled to the shaft and the feet of the user such that the band is taut when the user is in a proper address position for striking a golf ball.

16 Claims, 6 Drawing Sheets

GOLF SWING BACK ANGLE TRAINING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to golf swing training device and more particularly pertains to a new golf swing training device for providing tactile feedback when an undesired change in back angle occurs during a golf swing.

(2) Description of Related Art Including Information Disclosed Under 37 CFR 1.97 and 1.98

The prior art relates to golf swing training devices. Known prior art lacks tactile feedback relating to spine angle relative to the feet during a golf swing.

BRIEF SUMMARY OF THE INVENTION

An embodiment of the disclosure meets the needs presented above by generally comprising a belt for extending around a waist of a user. A shaft coupled to the belt is positioned in alignment with a spine of the user and extends downwardly towards feet of the user such that a bottom end of the shaft moves away from the feet as the user bends forwardly. A band is coupled to the shaft and the feet of the user such that the band is taut when the user is in a proper address position for striking a golf ball.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
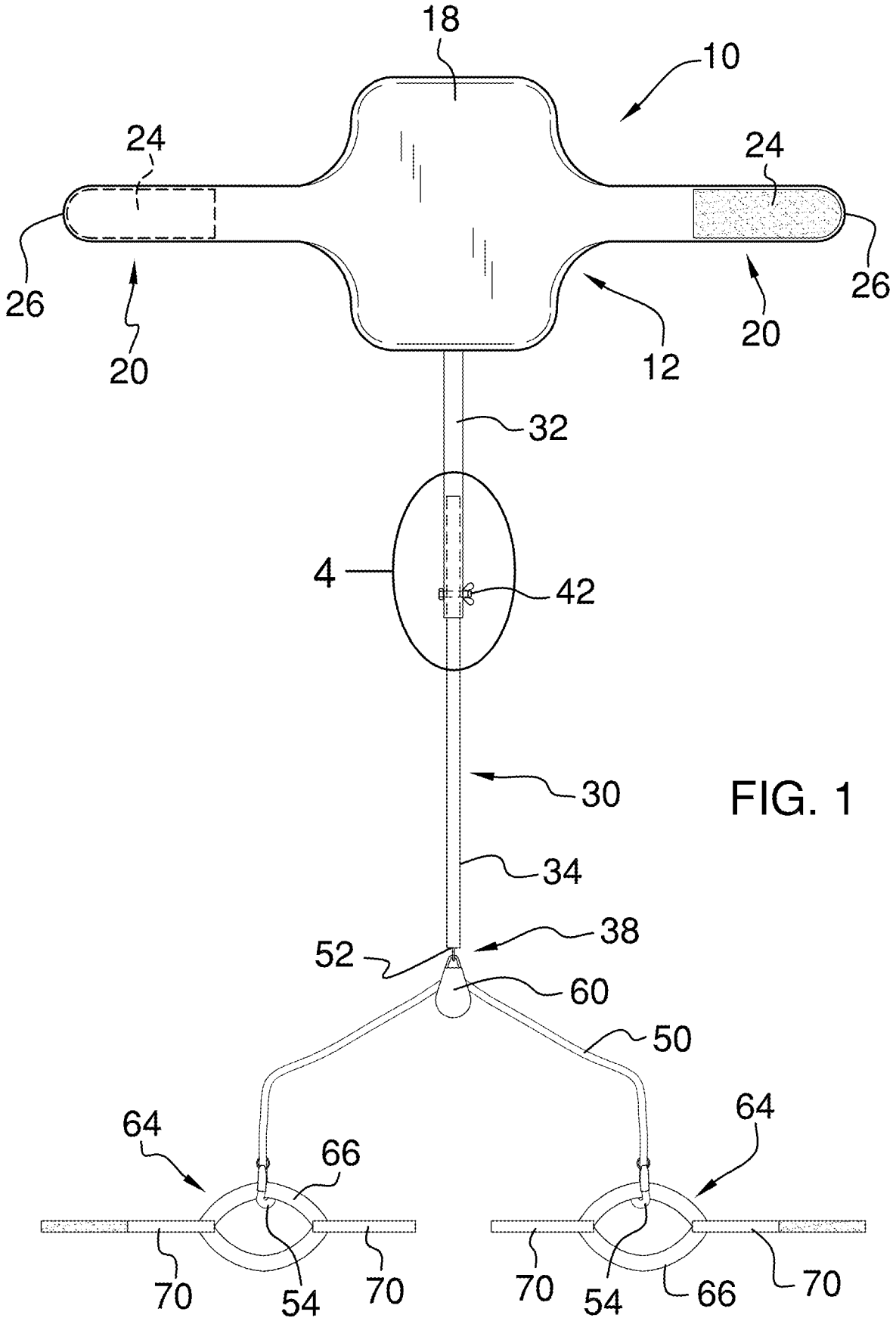
FIG. 1 is a front view of a golf swing back angle training device according to an embodiment of the disclosure.
Figure 2:
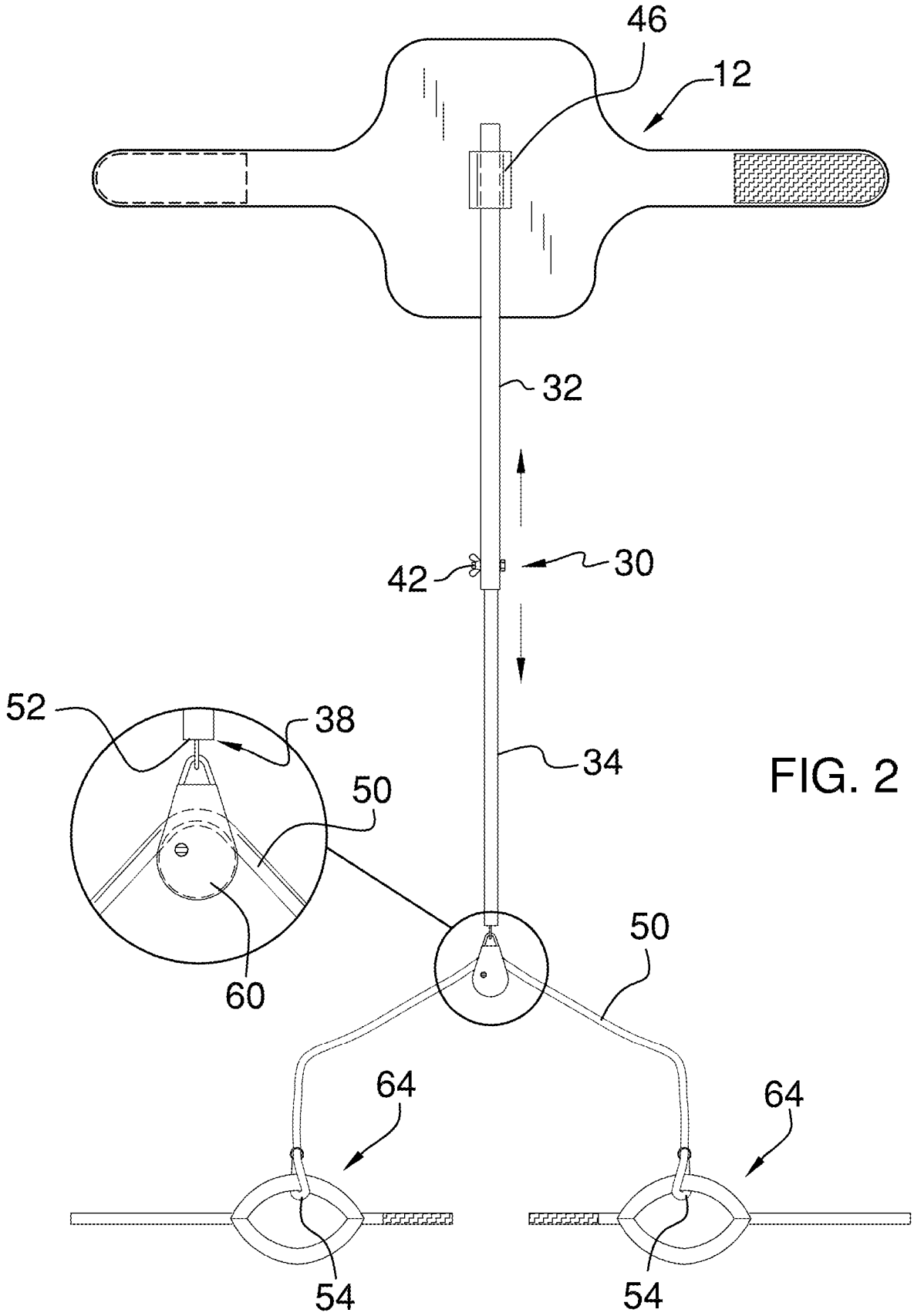
FIG. 2 is a rear view of an embodiment of the disclosure.
Figure 3:
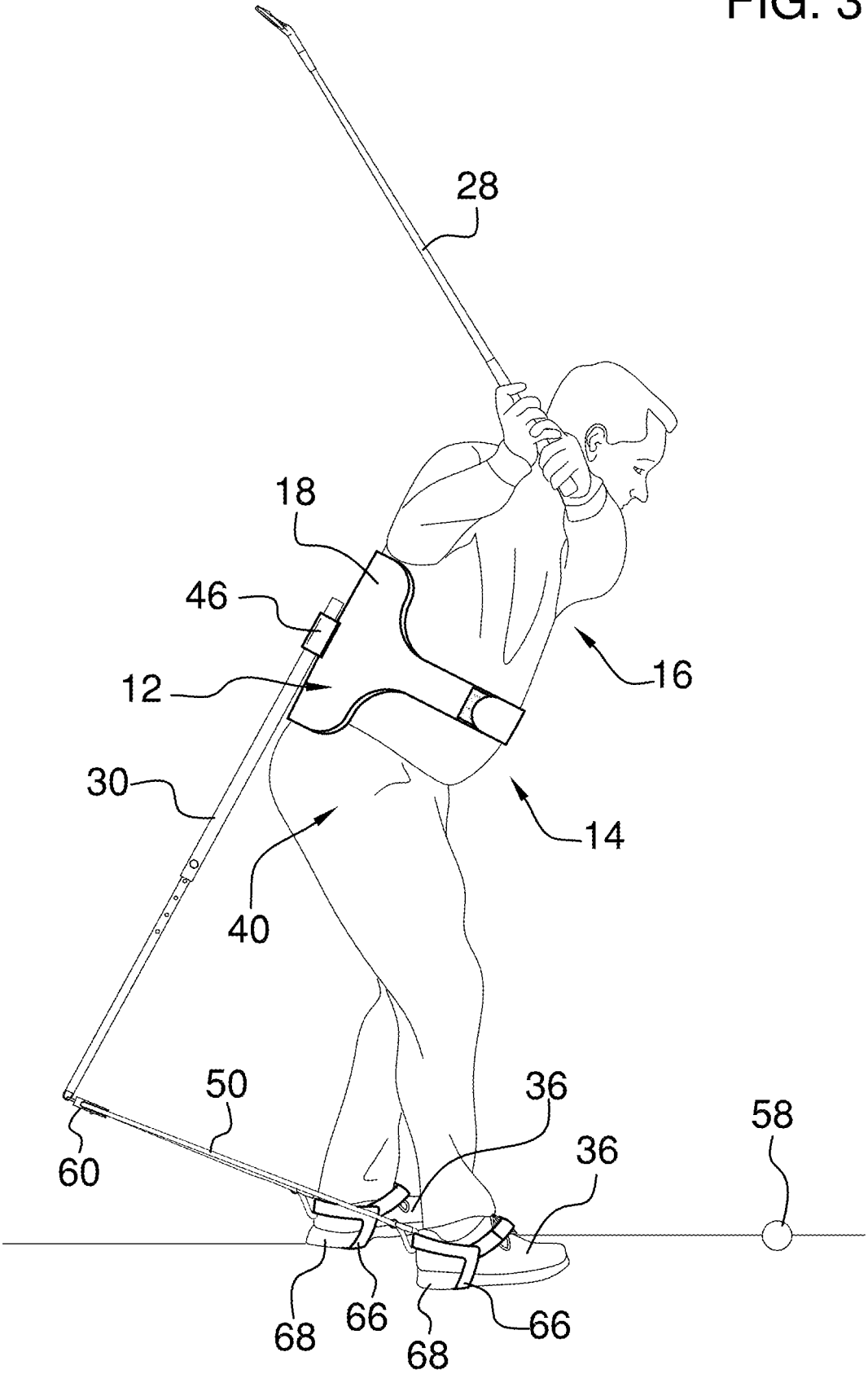
FIG. 3 is a side view of an embodiment of the disclosure in use.
Figure 4:
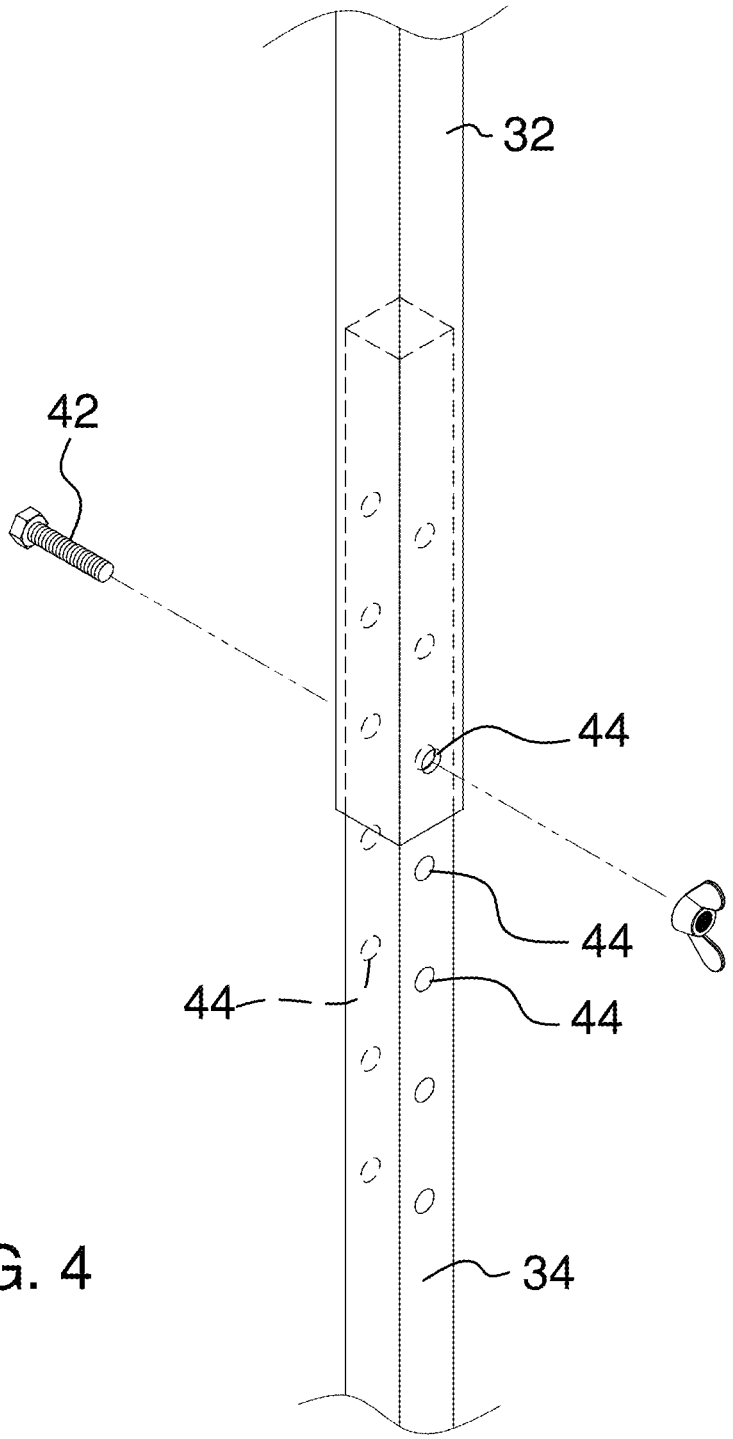
FIG. 4 is a detailed view of an embodiment of the disclosure indicated by line 4 as shown in FIG. 1.
Figure 5:
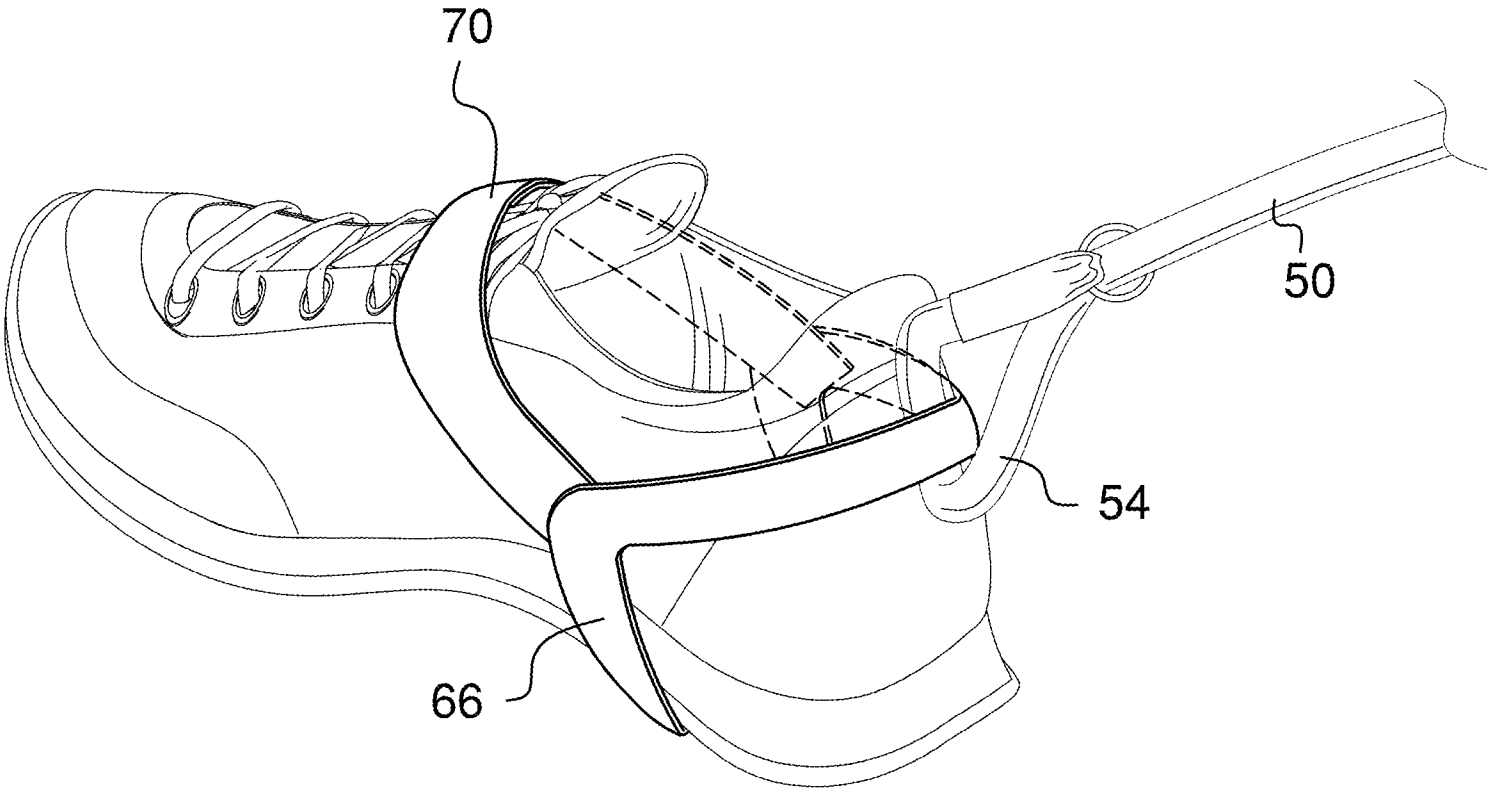
FIG. 5 is a detailed view of an embodiment of the disclosure.

With reference now to the drawings, and in particular to FIGS. 1 through 6 thereof, a new golf swing training device embodying the principles and concepts of an embodiment of the disclosure and generally designated by the reference numeral 10 will be described.

As best illustrated in FIGS. 1 through 6, the golf swing back angle training device 10 generally comprises a belt 12 for extending around a waist 14 of a user 16.

The belt 12 includes a wide medial section 18 positioned between opposed end sections 20 of the belt 12. The wide medial section 18 is configured for positioning over a lower back 22 of the user 16 when the belt 12 is coupled around the waist 14 of the user 16. The belt 12 is secured to the user 16 and may incorporate complementary sections of hook and loop fastener 24 coupled to overlappable portions or ends 26 of the belt 12 such that the belt 12 is configured for being adjustably secured to the waist 14 of the user 16 yet held snug sufficient to prevent slippage during the movement of swinging a golf club 28.

A shaft 30 is coupled to the belt 12 such that the shaft 30 is positioned in alignment with a spine of the user 16 and such that the shaft 30 extends downwardly from the belt 12. A length of the shaft 30 extending from the belt 12 is adjustable. The shaft 30 has an upper section 32 and a lower section 34. The upper section 32 is telescopically coupled to the lower section 34 such that the shaft 30 is extendable from the belt 12 and towards feet 36 of the user 16. A bottom end 38 of the shaft 30 is configured to move away from the feet 36 of the user 16 as the user 16 bends forwardly at hips 40 of the user 16. The upper portion 32 of the shaft 30 is coupled to and extends on the wide medial section 18 of the belt 12 such that the upper portion 32 is positioned in alignment with the spine of the user 16. The shaft 30 may have a square cross-sectional shape perpendicular to a longitudinal axis of the shaft 30 to inhibit twisting of the shaft 30. A fastener 42 is extendable through the upper section 32 and the lower section 34 at a selectable one of a plurality of apertures 44 spaced along a length of the shaft 30 wherein the fastener 42 fixes a position of the lower section 34 relative to the upper section 32. It is contemplated the apertures 44 would include a single aligned pair of the apertures 44 on one of the upper section 32 and lower section 34 and a plurality of spaced pairs of apertures 44 on the other of the upper section 32 and lower section 34. Thus, the length of the shaft 30 is adjustable.

A bracket 46 is coupled to the belt 12. The shaft 30 extends through the bracket 46 such that the shaft 30 is coupled to the belt 12. While a connector may be employed, the bracket 46 may be of a resilient material and alternatively frictionally engage the shaft 30 such that the shaft 30 resists sliding within the bracket 46. Thusly, the shaft 30 is statically engaged to the belt 12 while the user 16 swings the golf club 28. The bracket 46 may be centrally positioned on the belt 12 for being positioned in alignment with the spine of the user 16. The frictional engagement may be such that the user 16 may reposition the shaft 30 relative to the bracket 46 allowing for further adjustment of the length of the shaft 30 extending from the belt 12.

A band 50 is coupled to the shaft 30. The band 50 is coupled to a distal end 52 of the shaft 30 relative to the belt 12. Opposite ends 54 of the band 50 are configured for coupling to the feet 36 of the user 16. The band 50 has a length such that the band 50 is taut and inhibits further forward bending of the user 16 when the user 16 is in a proper address position for striking a golf ball 58. The band 50 may be resiliently stretchable along a length of the band 50 to provide gradual increasing resistance to bending during a golf swing.

A pulley 60 is coupled to the distal end 52 of the shaft 30. The band 50 extends through the pulley 60 wherein a position of the distal end 52 of the shaft 30 relative to the band 50 is freely adjustable. The pulley 60 is lockable such that a position of the distal end 52 of the shaft 30 on the band 12 is set when the pulley 60 is locked.

Each of a pair of foot slings 64 is coupled to a respective one of the opposite ends 54 of the band 50, Each foot sling 64 is configured for securing to a respective one of the feet 36 of the user 16. Thus, the band 50 is secured to the feet 36 of the user 16, Each foot sling 64 has a medial loop section 66 configured for receiving a heel 68 of the respective foot 36 of the user 16. Each foot sling 64 has a strap 70 coupled to and extending from the medial loop 66 such that the strap 70 is configured for securing the foot sling 64 to the respective foot 36 of the user 16. The strap 70 may be secured with hook and loop fastener or the like.

Figure 6:
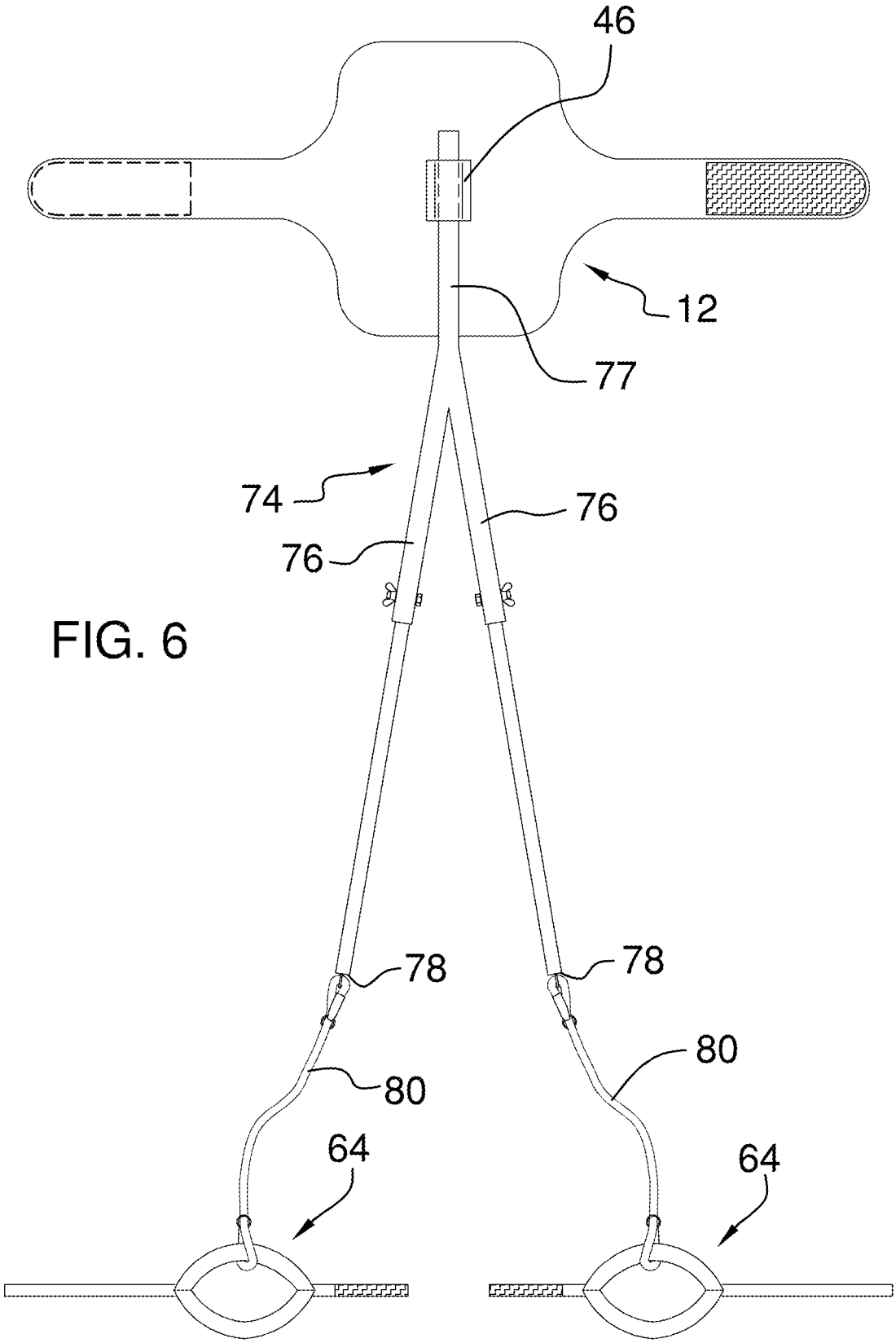
FIG. 6 is a rear view of an alternative embodiment of the disclosure.

It is contemplated that the shaft 30 may alternatively comprise a yoke 74 as shown in FIG. 6. The yoke 74 includes a central section 76 positioned in alignment with the spine of the user 16. The yoke 74 includes outwardly extending arms 76 which extend downwardly from the belt 12 and towards the feet 36 of the user 16. Bottom ends 78 of the arms 76 of the yoke 74 are configured to move away from the feet 36 of the user 16 as the user 16 bends forwardly similar to the movement of the distal end 52 of the shaft 30. Each of the arms 76 has an adjustable length using similar structure for adjusting the length of the shaft 30 as described above. When using the yoke 74, each a pair of bands 80 is coupled to a respective one of the arms 76 of the yoke 74. Each band 80 has a length such that each band 80 is taut and configured for inhibiting further forward bending of the user 16 when the user 16 is in a proper address position for striking the golf ball 58.

The length of either the band 50 or the bands 80 may be adjusted to further position the band 50 or bands 80 to be taut while the user 16 is in the desired and proper swing angle.

In use, the belt 12 is positioned on the waist 14 of the user 16. Each foot sling 64 is secured to the feet 36 of the user. The user 16 is positioned into the proper or desired address position in which the correct or desired amount of bend produces the desired back angle for the golf swing. The length of the shaft 30 or yoke 74, length of the band 50 or bands 80, is adjusted to produce the desired tension to give tactile feedback to the user 16 as to the proper amount of back angle for the golf swing. The user 16 may then practice repeatedly the golf swing and adjust the swing accordingly to maintain the desired back angle throughout the golf swing, With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure, Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf swing back angle training device comprising:

a belt configured for extending around a waist of a user;

a shaft coupled to said belt such that said shaft is configured for being positioned in alignment with a spine of the user and such that said shaft extends downwardly from said belt, wherein said shaft is configured for extending from said belt and towards feet of the user, a bottom end of said shaft being configured to move away from the feet of the user as the user bends forwardly at hips of the user;

a band coupled to said shaft, said band being configured for coupling to the feet of the user, said band having a length wherein said band is taut and configured for inhibiting further forward bending of the user when the user is in a proper address position for striking a golf ball; and a bracket coupled to said belt, said shaft extending through said bracket wherein said shaft is coupled to said belt, said bracket frictionally engaging said shaft wherein said shaft resists sliding within said bracket such that said shaft is configured to remain statically engaged to said belt while the user swings a golf club.

2. The golf swing back angle training device of claim 1, wherein said band is coupled to a distal end of said shaft relative to said belt.

3. The golf swing back angle training device of claim 1, wherein a length of said shaft extending from said belt is adjustable.

4. The golf swing back angle training device of claim 1, further comprising a pair of foot slings, each foot sling being coupled to a respective one of a pair of opposite ends of said band, each foot sling being configured for securing to a respective foot of the feet of the user whereby said band is secured to the feet of the user.

5. The golf swing back angle training device of claim 4, further comprising:

each foot sling having a medial loop section configured for receiving a heel of the respective foot of the feet of the user; and each foot sling having a strap coupled to and extending from said medial loop such that said strap is configured for securing said foot sling to the respective foot of the feet of the user.

6. The golf swing back angle training device of claim 1, further comprising said belt including a wide medial section positioned between opposed end sections of said belt, said wide medial section being configured for positioning over a lower back of the user when the belt is coupled around the waist of the user.

7. The golf swing back angle training device of claim 6, further comprising an upper portion of the shaft being coupled to and extending on said wide medial section of said belt wherein said upper portion is configured for being positioned in alignment with a spine of the user.

8. The golf swing back angle training device of claim 1, further comprising:

said shaft having an upper section and a lower section, said upper section being telescopically coupled to said lower section, and a fastener extendable through said upper section and said lower section at a selectable one of a plurality of apertures spaced along a length of said shaft wherein said fastener fixes a position of said lower section relative to said upper section whereby said length of said shaft is adjustable.

9. The golf swing back angle training device of claim 1, further comprising complementary sections of hook and loop fastener coupled to overlappable ends of said strap such that said belt is configured for being adjustably secured to the waist of the user.

10. The golf swing back angle training device of claim 1, further comprising said shaft having a square cross-sectional shape perpendicular to a longitudinal axis of said shaft.

11. The golf swing back angle training device of claim 1, further comprising said band being resiliently stretchable along a length of said band.

12. The golf swing back angle training device of claim 1, further comprising said bracket being centrally positioned on said belt wherein said bracket is configured for being positioned in alignment with the spine of the user.

13. The golf swing back angle training device of claim 1, further comprising:

said belt including a wide medial section positioned between opposed end sections of said belt, said wide medial section being configured for positioning over a lower back of the user when the belt is coupled around the waist of the user;

complementary sections of hook and loop fastener coupled to overlappable ends of said strap such that said belt is configured for being adjustably secured to the waist of the user;

a length of said shaft extending from said belt being adjustable, said shaft having an upper section and a lower section, said upper section being telescopically coupled to said lower section, said upper portion of said shaft being coupled to and extending on said wide medial section of said belt wherein said upper portion is configured for being positioned in alignment with a spine of the user, said shaft having a square cross-sectional shape perpendicular to a longitudinal axis of said shaft;

a fastener extendable through said upper section and said lower section at a selectable one of a plurality of apertures spaced along a length of said shaft wherein said fastener fixes a position of said lower section relative to said upper section whereby said length of said shaft is adjustable;

said bracket being centrally positioned on said belt wherein said bracket is configured for being positioned in alignment with the spine of the user;

said band being coupled to a distal end of said shaft relative to said belt, opposite ends of said band being configured for coupling to the feet of the user, said band being resiliently stretchable along a length of said band;

a pulley being coupled to said distal end of said shaft, said band extending through said pulley wherein a position of said distal end of said shaft relative to said band is freely adjustable, said pulley being lockable wherein a position of said distal end of said shaft on said band is set when said pulley is locked; and a pair of foot slings, each foot sling being coupled to a respective one of said opposite ends of said band, each foot sling being configured for securing to a respective foot of the feet of the user whereby said band is secured to the feet of the user, each foot sling having a medial loop section configured for receiving a heel of the respective foot of the feet of the user, each foot sling having a strap coupled to and extending from said medial loop such that said strap is configured for securing said foot sling to the respective foot of the feet of the user.

14. A golf swing back angle training device comprising:

a belt configured for extending around a waist of a user;

a shaft coupled to said belt such that said shaft is configured for being positioned in alignment with a spine of the user and such that said shaft extends downwardly from said belt, wherein said shaft is configured for extending from said belt and towards feet of the user, a bottom end of said shaft being configured to move away from the feet of the user as the user bends forwardly at hips of the user:

a band coupled to said shaft, wherein said band is coupled to a distal end of said shaft relative to said belt, said band being configured for coupling to the fect of the user, said band having a length wherein said band is taut and configured for inhibiting further forward bending of the user when the user is in a proper address position for striking a golf ball; and a pulley being coupled to said distal end of said shaft, said band extending through said pulley wherein a position of said distal end of said shaft relative to said band is freely adjustable.

15. The golf swing back angle training device of claim 14, further comprising said pulley being lockable wherein a position of said distal end of said shaft on said band is set when said pulley is locked.

16. A golf swing back angle training device comprising:

a belt configured for extending around a waist of a user;

a yoke coupled to said belt such that a central section of said yoke is configured for being positioned in alignment with a spine of the user and such that outwardly extending arms of said yoke extend downwardly from said belt, wherein said yoke is configured for extending from said belt and towards feet of the user, bottom ends of said arms of said yoke being configured to move away from the feet of the user as the user bends forwardly at hips of the user; and a pair of bands, each band being coupled to a respective one of said arms of said yoke, each band having a length wherein each said band is taut and configured for inhibiting further forward bending of the user when the user is in a proper address position for striking a golf ball.

* * * * *